US005725250A

United States Patent [19]

Balderrama

[11] Patent Number: 5,725,250

[45] Date of Patent: Mar. 10, 1998

[54] WRITING INSTRUMENT ENGAGING CLIPBOARD

[76] Inventor: Jose Roberto Balderrama, 6745 Dublin Ter., Colorado Springs, Colo. 80918-1326

[21] Appl. No.: 749,075

[22] Filed: Nov. 14, 1996

Related U.S. Application Data

[63] Continuation of Ser. No. 353,637, Dec. 12, 1994, abandoned.

[51] Int. Cl.[6] ..... B42F 9/00

[52] U.S. Cl. ..... 281/45; 281/30

[58] Field of Search ..... 281/30, 45; D19/88; 24/67.7, 67.3; 248/452, 451

[56] References Cited

U.S. PATENT DOCUMENTS

| | | | |
|---|---|---|---|
| 194,137 | 8/1877 | Dimmock | 281/45 |
| 938,025 | 10/1909 | Smoot | 281/30 X |
| 1,482,659 | 2/1924 | Oswald | 281/30 X |
| 1,609,418 | 12/1926 | Nechamikin et al. | 281/45 |
| 2,202,267 | 5/1940 | Posnack | 281/45 X |
| 2,527,216 | 10/1950 | Harris | 281/45 |
| 3,215,452 | 11/1965 | Goodwin | 281/45 |
| 3,399,429 | 9/1968 | Goodman | 281/45 X |
| 3,564,668 | 2/1971 | Kirk | 281/30 |
| 4,375,296 | 3/1983 | Chang | 281/45 |
| 4,743,050 | 5/1988 | Small | 281/45 |

*Primary Examiner*—Frances Han

[57] ABSTRACT

A clipboard for retaining a writing instrument and loose papers. The inventive device includes a planar member with a clip member pivotally mounted thereto by a spring-loaded hinge. An engaging aperture is formed in the clip member for partially surrounding and capturing a writing instrument between the clip member and the planar member.

5 Claims, 4 Drawing Sheets

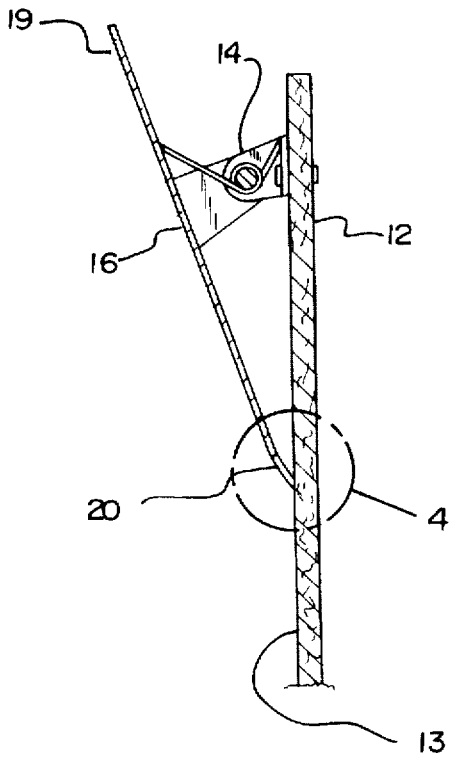
FIG. 3
FIG. 4
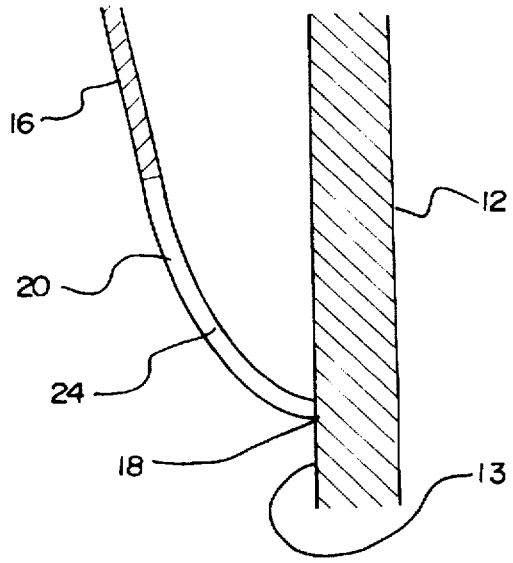

WRITING INSTRUMENT ENGAGING CLIPBOARD

This application is a continuation of application Ser. No. 08/353,637 filed Dec. 17,1994, now abandoned.

BACKGROUND OF THE INVENTION

1. Field of the Invention

The present invention relates to holding structures and more particularly pertains to an writing instrument engaging clipboard for retaining a writing instrument and loose papers.

2. Description of the Prior Art

The use of holding structures is known in the prior art. More specifically, holding structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art holding structures include U.S. Pat. No. 3,670,370; U.S. Pat. No. 4,948,172; U.S. Pat. No. 4,361,934; and U.S. Pat. No. 5,058,242.

While these devices fulfill their respective, particular objectives and requirements, the aforementioned patents do not disclose a writing instrument engaging clipboard for retaining a writing instrument and loose papers which includes a planar member with a clip member pivotally mounted thereto by a spring-loaded hinge, and an engaging aperture formed in the clip member for partially surrounding and capturing a writing instrument between the clip member and the planar member.

In these respects, the writing instrument engaging clipboard according to the present invention substantially departs from the conventional concepts and designs of the prior art, and in so doing provides an apparatus primarily developed for the purpose of retaining a writing instrument and loose papers.

SUMMARY OF THE INVENTION

In view of the foregoing disadvantages inherent in the known types of holding structures now present in the prior art, the present invention provides a new writing instrument engaging clipboard construction wherein the same can be utilized for retaining a writing instrument and loose papers. As such, the general purpose of the present invention, which will be described subsequently in greater detail, is to provide a new writing instrument engaging clipboard apparatus and method which has many of the advantages of the holding structures mentioned heretofore and many novel features that result in a writing instrument engaging clipboard which is not anticipated, rendered obvious, suggested, or even implied by any of the prior art holding structures, either alone or in any combination thereof.

To attain this, the present invention generally comprises a clipboard for retaining a writing instrument and loose papers. The inventive device includes a planar member with a clip member pivotally mounted thereto by a spring-loaded hinge. An engaging aperture is formed in the clip member for partially surrounding and capturing a writing instrument between the clip member and the planar member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new writing instrument engaging clipboard apparatus and method which has many of the advantages of the holding structures mentioned heretofore and many novel features that result in a writing instrument engaging clipboard which is not anticipated, rendered obvious, suggested, or even implied by any of the prior art holding structures, either alone or in any combination thereof.

It is another object of the present invention to provide a new writing instrument engaging clipboard which may be easily and efficiently manufactured and marketed.

It is a further object of the present invention to provide a new writing instrument engaging clipboard which is of a durable and reliable construction.

An even further object of the present invention is to provide a new writing instrument engaging clipboard which is susceptible of a low cost of manufacture with regard to both materials and labor, and which accordingly is then susceptible of low prices of sale to the consuming public, thereby making such writing instrument engaging clipboards economically available to the buying public.

Still yet another object of the present invention is to provide a new writing instrument engaging clipboard which provides in the apparatuses and methods of the prior art some of the advantages thereof, while simultaneously overcoming some of the disadvantages normally associated therewith.

Still another object of the present invention is to provide a new writing instrument engaging clipboard for retaining a writing instrument and loose papers.

Yet another object of the present invention is to provide a new writing instrument engaging clipboard which includes a planar member with a clip member pivotally mounted thereto by a spring-loaded hinge, and an engaging aperture formed in the clip member for partially surrounding and capturing a writing instrument between the clip member and the planar member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is an enlarged cross section illustration of the area set forth in FIG. 3.

DESCRIPTION OF THE PREFERRED EMBODIMENT

Figure 1:
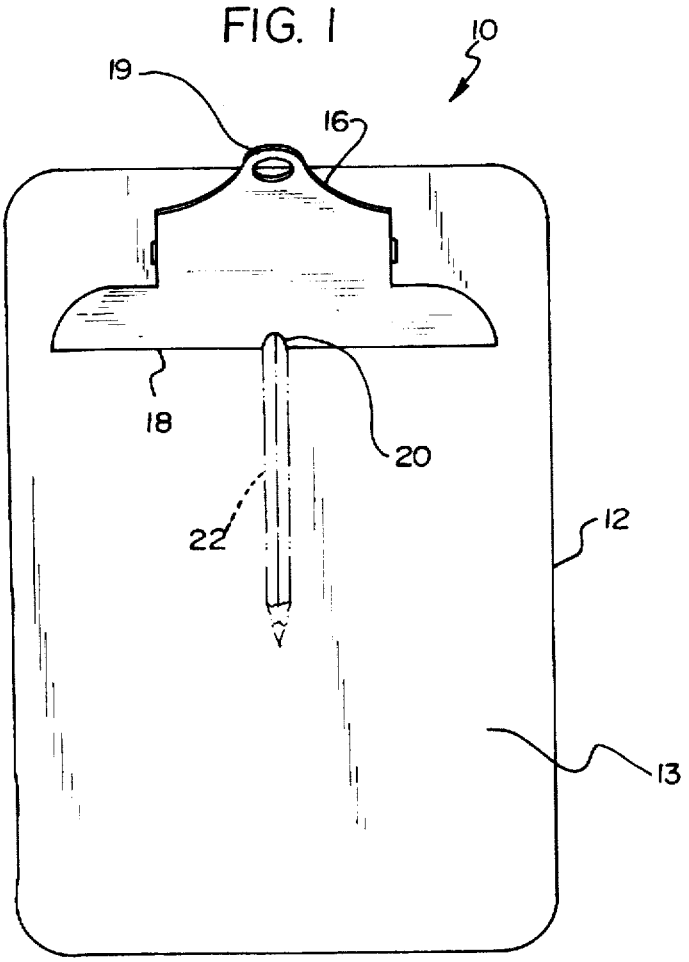
FIG. 1 is a front elevation view of a writing instrument engaging clipboard.

With reference now to the drawings, and in particular to FIGS. 1–9 thereof, a new writing instrument engaging clipboard embodying the principles and concepts of the present invention and generally designated by the reference numeral 10 will be described.

Figure 2:
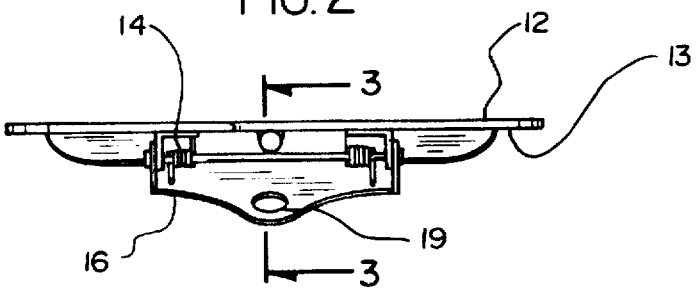
FIG. 2 is a top plan view thereof.
Figure 5:
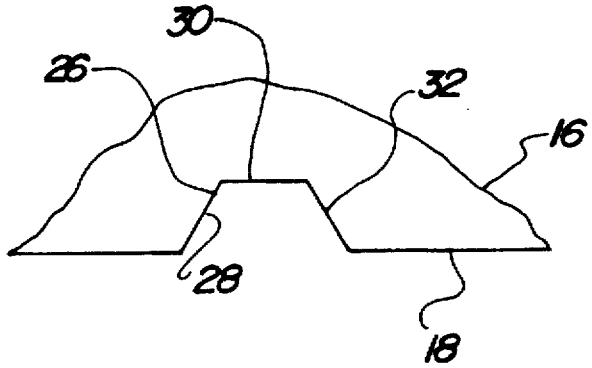
FIG. 5 is a front elevation view of a first form of an engaging means of the present invention.

More specifically, it will be noted that the writing instrument engaging clipboard 10 comprises a planar member 12 of preferably rectangular shape. The planar member 12 has a front face 13. A spring-loaded hinge 14 is mounted to an upper portion of the planar member 12, as shown in FIGS. 1 and 2. A clip member 16 is pivotally mounted to the spring-loaded hinge 14. The clip member 16 has a straight engaging edge 18 positioned for abutting engagement with the front face 13 of the planer member 12. The clip member 16 also has a leveraging arm 19 provided opposite the straight engaging edge 18. The spring-loaded hinge 14 is resiliently biased so as to position the straight engaging edge 18 into abutting engagement with the front face 13 of the planar member 12 so as to capture loose papers and the like between the clip member 16 and the front face 13 of the planar member 12. The leveraging arm 19 of the clip member 16 allows a user therof to manually pivot the clip member 16 and disengage the straight engaging edge 18 from abutting engagement with the front face 13 of the planar member 12 and remove loose papers and the like from between the clip member 16 and the front face 13 of the planar member 12. The leaveraging arm 19 of the clip member 16 allows a user thereof to manually pivot the clip member 16 and disengage the straight engaging edge 18 from abutting engagement with the front face 13 of the planar member 12 and remove loose papers and the like from between the clip member 16 and the front face 13 of the planar member 12. As shown in FIG. 1, the clip member 16 includes an engaging means 20 for partially surrounding and capturing a writing instrument 22 between the front face 13 of the planar member 12 and the clip member 16. The engaging means 20 secures the writing instrument 22 parallel against the planar member 12.

As best illustrated in FIGS. 3 and 4, it can be shown that the engaging means 20 according to the present invention 10 comprises an aperture 24 formed into the clip member 16 and extending into contiguous communication with the straight engaging edge 18. The aperture 24 is open to the straight engaging edge 18 and only partially surrounds the writing instrument 22. As such, the writing instrument 22 is captured between the front face 13 of the planar member 12 and the clip member 16 and is secured parallel against the planar member 12. As a result of the aperture 24 extending into contiguous communication with and being open to the straight engaging edge 18 of the clip member 16, the straight engaging edge 18 remains in abutting engagement with the front face 13 of the planar member 12 when the writing instrument 22 is surrounded and captured parallel against the planar member 12 In addition, the writing instrument 22 remains in a parallel relationship with the planar member 12 when the straight engaging edge 18 of the clip member 16 is disengaged from abutting engagement with the front face 13 of the planar member 12 by the leveraging arm 19. Preferably the aperture 24 of the engaging means 20 is substantially centered along the straight engaging edge 18 of the clip member 16 as shown in FIG. 1.

Turning now to FIGS. 5 through 9, it can be shown that the aperture 24 of the engaging means 20 may comprise a semi-hexagonal aperture 26 including a first lateral edge 28 intersecting and projecting from the straight engaging edge 18 at an oblique angle thereto. The first lateral edge 28 intersects an upper edge 30 oriented so as to extend substantially parallel to the straight engaging means 18. A second lateral edge 32 of the semi-hexagonal aperture 26 intersects the upper edge 30 and the straight engaging edge 18 and is oriented so as to extend at an oblique angle relative to the straight engaging edge. Thus, the edges 28–32 of the semi-hexagonal aperture 26 cooperate to engage approximately one-half of a conventionally known pencil having a hexagonal shape.

Figure 6:
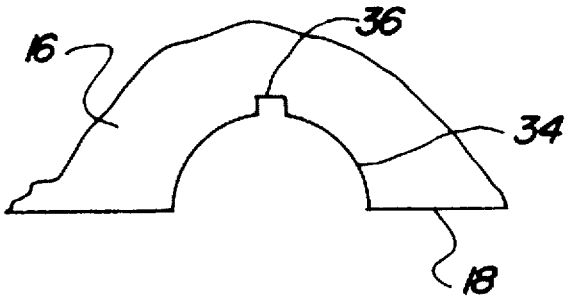
FIG. 6 is a front elevation view of a second form of the engaging means.
Figure 7:
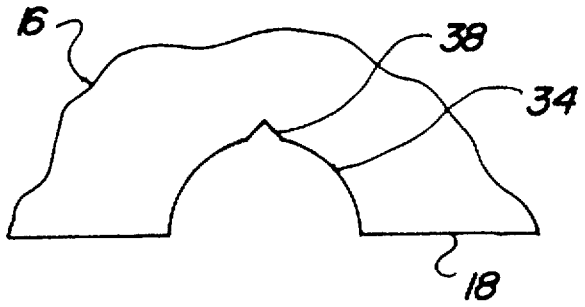
FIG. 7 is a front elevation view of a third form of the engaging means.
Figure 8:
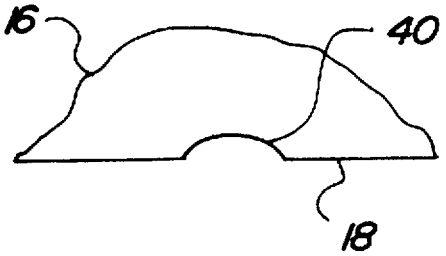
FIG. 8 is a front elevation view of a fourth form of the engaging means.

As shown in FIGS. 6 and 7, the aperture 24 of the engaging means 20 may comprise a semi-circular aperture 34 extending into contiguous communication with the straight engaging edge 18 and including a notch symmetrically centered and extending into contiguous communication with the semicircular aperture 34. The notch is operable to receive the retaining clip of a pen cap or the like therewithin such that the semi-circular aperture 34 of the clip member 16 can engage the cap to capture the same between the clip member 16 and the planar member 12. Thus, the notch may take the form of a rectangular notch 36, as illustrated in FIG. 6, or a V-shaped notch as shown in FIG. 7.

To accommodate writing instruments having an odd or non-uniform cross-sectional shape, the aperture 24 of the engaging means 20 may simply comprise an ellipsoidal aperture 40 directed into the clip member 16 and positioned in contiguous communication with the straight engaging edge 18.

Figure 9:
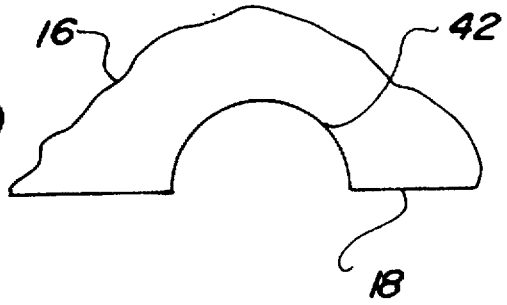
FIG. 9 is a front elevation view of a fifth form of the engaging means.

As shown in FIG. 9, the aperture 24 of the engaging means 20 may simply comprise a semi-circular aperture 42 extending into contiguous communication with the straight engaging edge 18, as also illustrated in FIGS. 1 through 4.

In use, the writing instrument engaging clip board 10 according to the present invention can be easily utilized to capture a writing instrument 22 and papers between the clip members 16 and the front face of the planar member 12 to retain such writing accessories in a readily accessible position. Further, the aperture 24 of the engaging means 20 as illustrated in FIGS. 6 and 7 including the notches 36 and 38 permits reception of a pen cap, whereby the cap may be retained between the clip member 16 and the front face of the planar member 12 with the associated pen being selectively removable from the cap and replaceable as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A writing instrument engaging clipboard comprising:

a planar member;

a spring-loaded hinge mounted to an upper portion of the planar member; and a clip member pivotally mounted to the spring-loaded hinge, the clip member having a straight engaging edge and a leveraging arm opposite the straight engaging edge, the clip member pivotable between an engaged position and a disengaged position by the leveraging arm, the straight engaging edge of the clip member abutting a front face of the planar member when the clip member is in the engaged position, the clip member having an aperture therein extending into contiguous communication with the straight engaging edge of the clip member for capturing a writing instrument in a parallel relationship against the planar member when the clip member is in the engaged position, the aperture being defined by an aperture edge including a pair of lateral edge portions and an end edge portion, the end edge portion having a substantially semi-circular shape approximating the profile of a writing instrument to thereby maximize abutting contact between the end edge portion of the aperture and a writing instrument extending through. the aperture, the pair of lateral edge portions extending from the end edge portion in a spaced substantially parallel relationship and intersecting the straight engaging edge of the clip member at a substantially perpendicular angle to the straight engaging edge such that the pair of lateral edge portions are positioned closely adjacent to a writing instrument extending through the aperture and abutting the end edge portion, whereby the clip member is located closely adjacent to a writing instrument extending through the aperture to thereby maximize retention of the writing instrument against the planar member by the clip member.

2. The writing instrument engaging clipboard of claim 1, wherein the aperture includes a notch symmetrically centered and extending into contiguous communication with the end edge portion of the aperture, wherein the notch is operable to receive a retaining clip of a pen cap therewithin with the end edge portion of the aperture of the clip member being engagable to the cap to capture the cap between the clip member and the planar member.

3. The writing instrument engaging clipboard of claim 2, wherein the notch is a rectangular notch.

4. The writing instrument engaging clipboard of claim 2, wherein the notch is a V-shaped notch.

5. The writing instrument engaging clipboard of claim 1, wherein the aperture is substantially centered along the straight engaging edge of the clip member.

* * * * *